US006392511B1

(12) United States Patent
Ke

(10) Patent No.: US 6,392,511 B1
(45) Date of Patent: May 21, 2002

(54) RF IMPEDANCE SELECTOR AND/OR RF SHORT SWITCH

(75) Inventor: Meng-Kun Ke, Parsippany, NJ (US)

(73) Assignee: Lucent Technologies Inc., Murray Hill, NJ (US)

( * ) Notice: Subject to any disclaimer, the term of this patent is extended or adjusted under 35 U.S.C. 154(b) by 0 days.

(21) Appl. No.: 09/418,703

(22) Filed: Oct. 15, 1999

(51) Int. Cl.[7] ..... H01P 1/00

(52) U.S. Cl. ..... 333/263; 333/33

(58) Field of Search ..... 333/263, 33, 34, 333/35, 262

(56) References Cited

U.S. PATENT DOCUMENTS 5,545,949 A * 8/1996 Bacher ..... 315/39

* cited by examiner

*Primary Examiner*—Benny Lee
*Assistant Examiner*—Stephen E. Jones
(74) *Attorney, Agent, or Firm*—Fay Sharpe Fagan Minnich & McKee LLP

(57) ABSTRACT

An impedance selector includes an input port receiving input signals. An outer conductor electrically communicates with the input port. A dielectric material is encircled by the outer conductor. An inner conductive core is encircled by the outer conductor and electrically communicates with the input port. An output port electrically communicates with the input port via the outer conductor and the inner core. A characteristic impedance of the outer conductor and the inner core is selectively set as a function of a minimum distance between the inner core and the outer conductor.

18 Claims, 7 Drawing Sheets

RF IMPEDANCE SELECTOR AND/OR RF SHORT SWITCH

BACKGROUND OF THE INVENTION

The present invention relates to coaxial cable transmission lines. It finds particular application in conjunction with impedance matching coaxial cable transmission lines, and will be described with particular reference thereto. It will be appreciated, however, that the invention is also amenable to other like applications.

Coaxial cables are known to comprise an inner conductor, a dielectric material, and an outer conductor. The outer conductor comprises a conductive material that encircles both the inner conductor and dielectric material. Electrically, the outer conductor shields the inner conductor that is carrying an electrical signal. In this manner, electromagnetic interference (EMI) radiated from the coaxial cable is minimized. The dielectric material, which encircles the inner conductor, electrically isolates the inner conductor from the outer conductor. The dielectric material is selected based on the characteristic impedance desired for the coaxial cable.

As is also known, coaxial cables are used to electrically couple high frequency signals from one circuit to another. Care should be taken when coupling RF coaxial wires to ensure that the characteristic impedances of the members to be connected are substantially matched. Coaxial cables having substantially matched impedances limit losses resulting from reflections and the like.

Coaxial connectors provided with means for impedance control or matching are known in the art. In order to achieve a desired impedance, use is made of passive electronic components such as resistors, coils, and capacitors, which are typically included in the connector casing. These components take up relatively large amounts of space, which has an adverse effect on the dimensions of the connectors. Furthermore, it is disadvantageous from an assembly point of view to mount separate resistors, coils and the like in a connector casing and electrically connect those components to the contact members in question.

A need exists for an RF selector that allows a user to selectively change the characteristic impedance of a coaxial cable without the use of impedance controlling coaxial connectors.

The present invention provides a new and improved apparatus and method which overcomes the above-referenced problems and others.

SUMMARY OF THE INVENTION

An impedance selector includes an input port receiving input signals. An outer conductor electrically communicates with the input port. A dielectric material is encircled by the outer conductor. An inner conductive core is encircled by the outer conductor and electrically communicates with the input port. An output port electrically communicates with the input port via the outer conductor and the inner core. A characteristic impedance of the outer conductor and the inner core is selectively set as a function of a minimum distance between the inner core and the outer conductor.

In accordance with one aspect of the invention, a rotation device non-concentrically encircles the outer conductor. The outer conductor moves in a fixed relationship with respect to the rotation device. The minimum distance changes as a function of selected rotational positions of the rotation device.

In accordance with another aspect of the invention, at least one additional outer conductor electrically communicates with the input and output ports. Each of the outer conductors has a distinct respective diameter and encircles independent portions of the dielectric material. The inner conductive core is encircled by a selected one of the outer conductors. The minimum distance is defined as a function of the selected outer conductor encircling the inner core.

Another advantage of the present invention is that an impedance can be selectively set to provide an impedance matching between an input and an output port.

Another advantage of the present invention is that the impedance selector is a less expensive alternative to conventional RF switches.

Another advantage of the present invention is that the impedance selector provides less insertion loss than conventional switches.

Another advantage of the present invention is that the impedance selector requires less hardware than conventional designs.

Still further advantages of the present invention will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawings are only for purposes of illustrating a preferred embodiment and are not to be construed as limiting the invention.

DETAILED DESCRIPTION OF THE PREFERRED EMBODIMENTS

Figure 1:
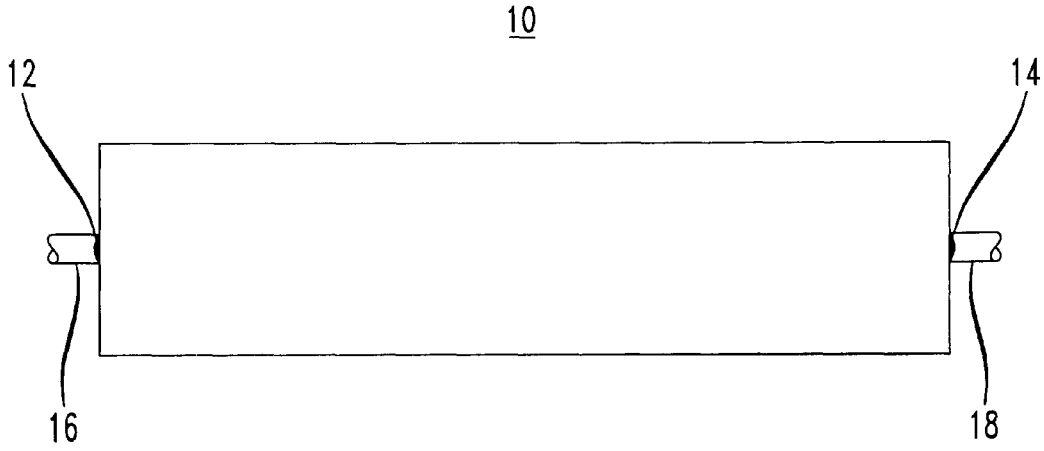
FIG. 1 illustrates an impedance selector according to the present invention.

FIG. 1 illustrates an impedance selector 10 according to the present invention. The selector 10 includes an input port 12 and an output port 14. The input port 12 is electrically connected to an external source connector 16. The source connector 16 provides input signals to the input port 12 from an external source. The output port 14 is electrically connected to an external destination connector 18. The destination connector 18 provides output signals from the selector 10 to an external destination. In the preferred embodiment, radio frequency ("RF") signals are received into the input port 12. The selector 10 creates the output signals as a function of the input signals. The output signals, which are also preferably RF signals, are transmitted from the output port 14 to the destination connector 18. An impedance of the selector 10 can be selected to substantially match the impedance of the source connector 16 to the destination connector 18. In this manner, the power of the RF signal received into the input port 12 is substantially transmitted to the output port 14.

With reference to FIGS. 2A–2C and 3A–3E, a rotation device 30 is preferably substantially cylindrically-shaped. A first bore 32 extends along a central axis of, and is non-concentric with, the rotation device 30. A motorized device 34, which contacts an outside portion of the rotation device 30, causes the device 30 to rotate to selected rotational positions. In the preferred embodiment, the rotation device 30 is rotated to one (1) of five (5) selected rotational positions. However, other embodiments, in which the rotation device 30 rotates to any number of positions, are also contemplated.

An outer conductor 36, which includes a conductive material (e.g., a metal) and is of a unitary design, substantially extends through, and is secured within, the first bore 32. The outer conductor 36 is substantially concentric with the first bore 32 and, therefore, is non-concentric with the rotation device 30. A second bore 38 extends along a central axis of, and is concentric with, the outer conductor 36.

An inner conductive core 42, which also includes a conductive material (e.g., a metal), substantially extends through the second bore 38. The outer conductor 36 completely encircles the inner core 42. An inside diameter of the outer conductor 36 is preferably at least three (3) times larger than an outside diameter of the inner core 42. The inner core 42 is electrically and mechanically secured to the source connector 16 and the destination connector (not shown in FIGS. 2A–2C). The outer conductor 36 also electrically communicates with the source and destination connectors.

A dielectric material 44 is also included within the second bore 38. In the preferred embodiment, the dielectric material is a gas (e.g., air), which has a relative permitivity of one (1). However, other dielectric materials having other relative permitivities (e.g., liquids) are also contemplated.

Because the inner core 42 is not secured to either the first bore 32 or the outer conductor 36, a minimum distance 46 between the outside surface of the inner core 42 and the inside surface of the outer conductor 36 changes as the rotation device 30 is rotated. A characteristic impedance Z of the inner core 42 and the outer conductor 36 changes as a function of the minimum distance between the inner core 42 and the outer conductor 36. Therefore, the characteristic impedance Z changes as a function of a rotational (i.e., angular) position of the rotation device 30.

FIGS. 3A–3E illustrate respective relative positions of the inner core 42 and outer conductor 36 for various angular positions of the rotation device 30. Rotational centers 48, which represent respective centers of the rotation device 30 , are indicated in each of FIGS. 3A–3E. The rotational centers 48 are coincident with respective midpoints between the center 54 of the inner core 42 and the center 52 of the outer conductor 36.

Figure 3A:
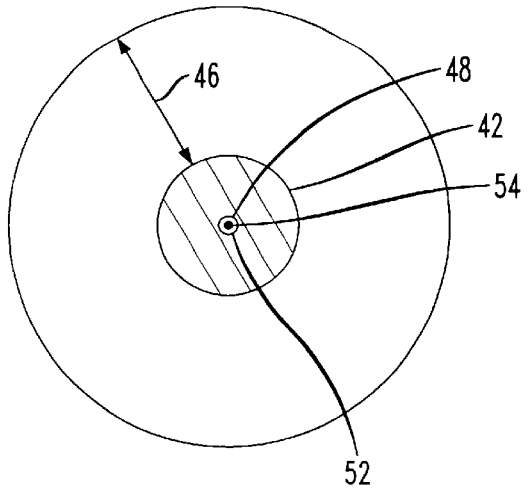
FIGS. 3A, 3B, 3C, 3D, and 3E illustrate cross-sectional views, along a radial axis, of the impedance selector according to the first embodiment.

FIG. 3A illustrates a case in which the inner core 42 and the outer conductor 36 are concentric. In other words, respective centers 54, 52 of the inner core 42 and the outer conductor 36 are substantially aligned along a longitudinal axis of the second bore 38. Therefore, the minimum distance 46 between the outside surface of the inner core 42 and the inside surface of the outer conductor 36 is substantially constant at every angular position around the inner core 42. The characteristic impedance Z is defined to be $Z_0$ for the concentric alignment of the inner core 42 and the outer conductor 36 shown in FIG. 3A. It is to be understood that the alignment between the inner core 42 and the outer conductor 36 are achieved when the rotation device 30 is rotated to a first rotational position.

FIGS. 3B–3E illustrate respective cases in which the inner core 42 and the outer conductor 36 are non-concentric. As discussed in more detail below, the respective characteristic impedances Z for each of the cases illustrated in FIGS. 3B–3E is less than the characteristic impedance $Z_0$ for the case illustrated in FIG. 3A. Furthermore, the characteristic impedance Z is reduced as the minimum distance 46 between the inner core 42 and the outer conductor 36 increases. It is to be understood that the various characteristic impedances are achieved at respective rotational positions of the rotation device 30.

Figure 3B:
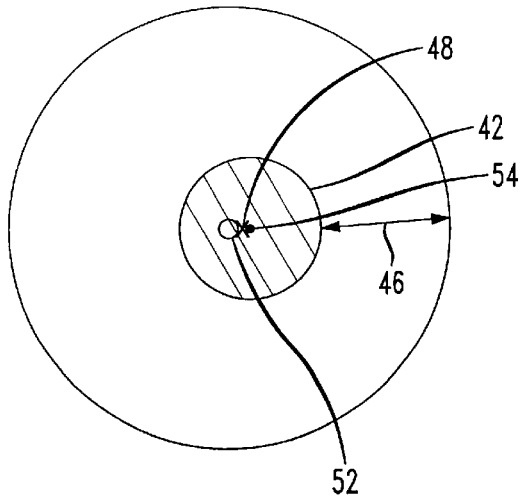

FIG. 3B illustrates the relative positions of the inner core 42 and the outer conductor 36 for a second rotational position of the rotation device 30. In FIG. 3B, the respective centers 54, 52 of the inner core 42 and the outer conductor 36 are slightly misaligned and, therefore, not concentric. Furthermore, the minimum distance 46 between the inner core 42 and the outer conductor 36 in FIG. 3B is slightly less than the minimum distance 46 shown in FIG. 3A. The characteristic impedance Z for the case shown in FIG. 3B is, for example, $$\frac{Z_o}{\sqrt{2}}.$$

Figure 3C:
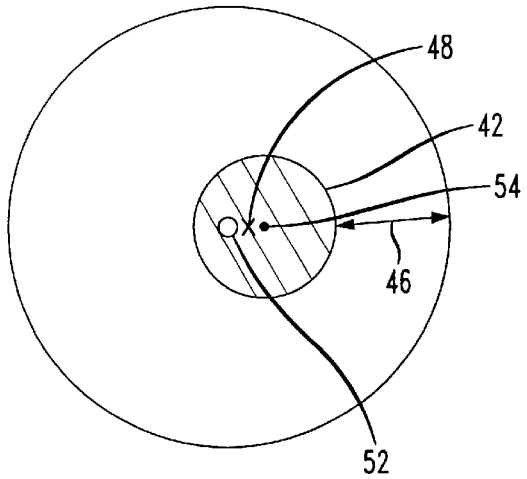

FIG. 3C illustrates the relative positions of the inner core 42 and the outer conductor 36 for a third rotational position of the rotation device 30. In FIG. 3C, the respective centers 54, 52 of the inner core 42 and the outer conductor 36 are misaligned more, and, therefore, the characteristic impedance Z is less, than the case shown in FIG. 3B. Furthermore, the minimum distance 46 between the inner core 42 and the outer conductor 36 in FIG. 3C is less than the minimum distance 46 shown in FIG. 3B. The characteristic impedance Z for the case shown in FIG. 3C is, for example, $$\frac{Z_o}{\sqrt{3}}.$$

Figure 3D:
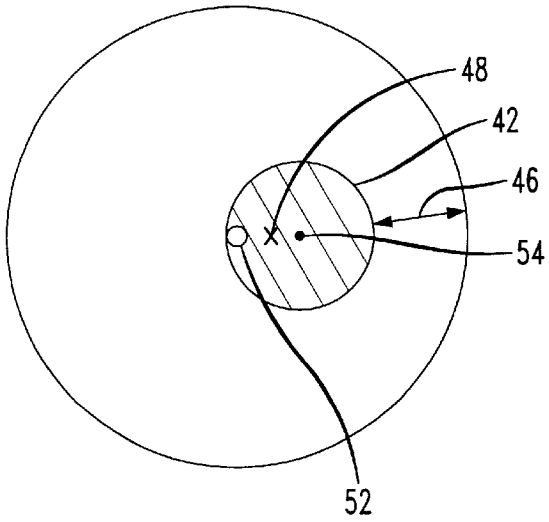

FIG. 3D illustrates the relative positions of the inner core 42 and the outer conductor 36 for a fourth rotational position of the rotation device 30. In FIG. 3D, the respective centers 54, 52 of the inner core 42 and the outer conductor 36 are misaligned more, and, therefore, the characteristic impedance Z is less, than the case shown in FIG. 3C. Furthermore, the minimum distance 46 between the inner core 42 and the outer conductor 36 in FIG. 3D is less than the minimum distance 46 shown in FIG. 3C. The characteristic impedance Z for the case shown in FIG. 3D is, for example, $$\frac{Z_o}{\sqrt{4}}\left(\text{i.e., } \frac{Z_o}{2}\right)$$

Figure 3E:
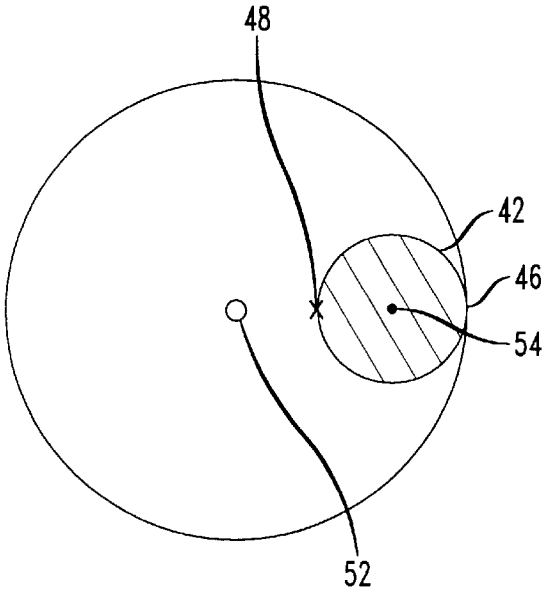

FIG. 3E illustrates the relative positions of the inner core 42 and the outer conductor 36 for a fifth rotational position of the rotation device 30. In FIG. 3E, the inner core 42 contacts the outer conductor 36 and, therefore, creates an RF short circuit. In this case, the minimum distance 46 is zero (0). Furthermore, the characteristic impedance Z is also zero (0).

It can be seen from FIGS. 3A–3E that the maximum characteristic impedance $Z_0$ is achieved when the center 54 of the inner core 42 is coincident with the center 52 of the outer conductor 36 (see FIG. 3A). The characteristic impedance is reduced as the minimum distance 46 between the inner core 42 and the outer conductor 36 decreases. Eventually, when the minimum distance 46 between the inner core 42 and the outer conductor 36 becomes zero (0) (i.e., when the inner core 42 contacts the outer conductor 36), the characteristic impedance becomes zero (0) (i.e., the inner core 42 is shorted to the outer conductor 36).

Figure 2A:
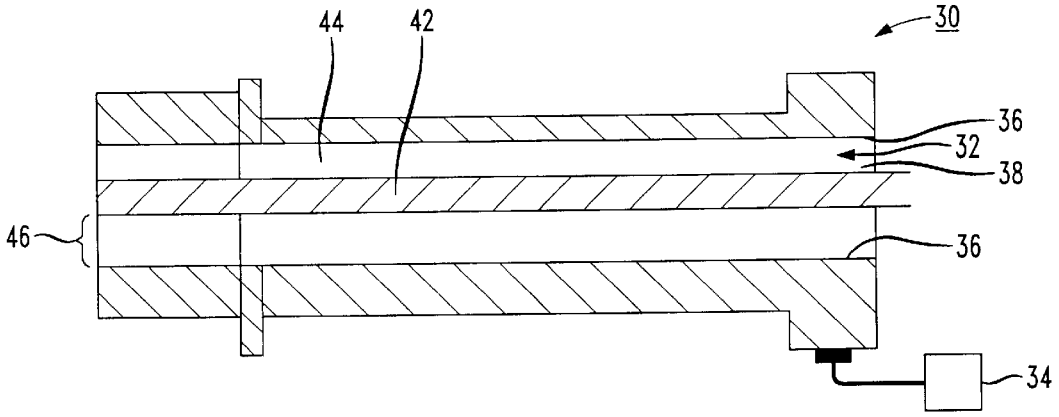
FIGS. 2A, 2B, and 2C illustrate cross-sectional views of the impedance selector according to a first embodiment.

It is to be understood that the axial cross-sectional view shown in FIG. 2A corresponds to the lateral cross-sectional view shown in FIG. 3A. More specifically, the respective centers of the inner cores 42 in each of FIGS. 2A and 3A are substantially coincident with the respective centers of the outer conductors 36. As discussed above, the characteristic impedance in this case is $Z_0$.

Figure 2B:
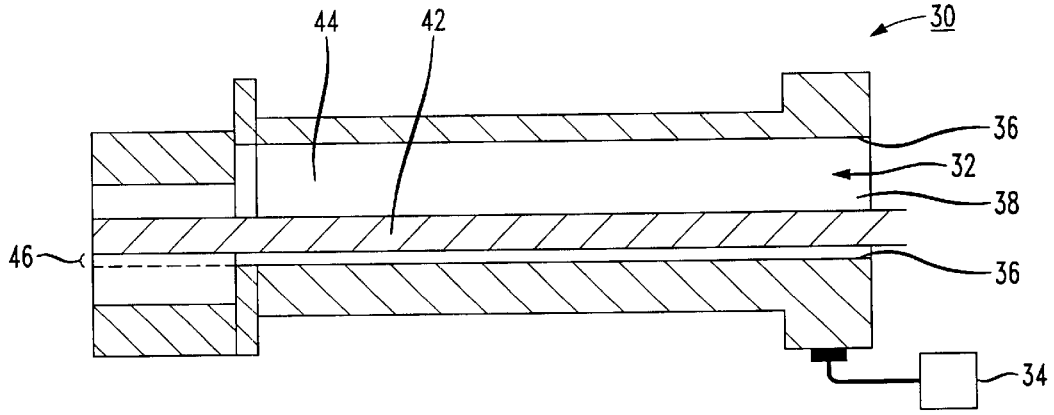
Figure 2C:
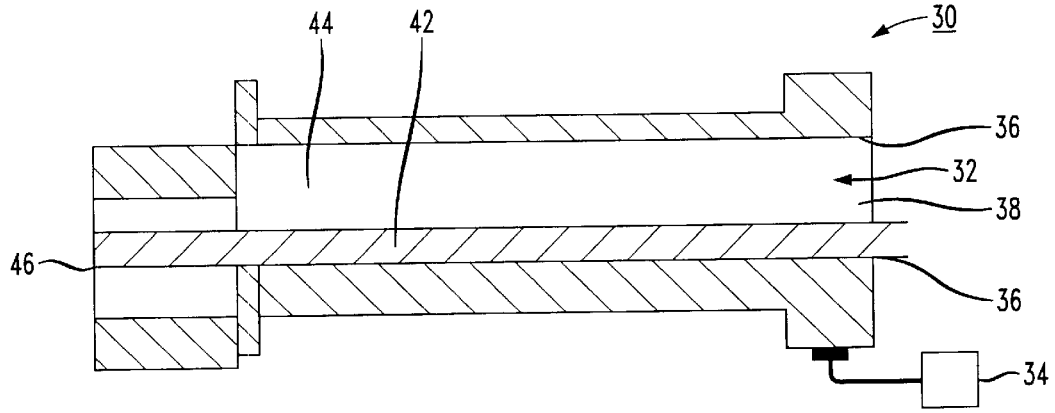

The axial cross-sectional view shown in FIG. 2C corresponds to the lateral cross-sectional view shown in FIG. 3E. More specifically, the respective inner cores 42 in each of FIGS. 2C and 3E contact the respective outer conductors 36. Therefore, the characteristic impedance is zero (0).

In the sense that the respective characteristic impedances are between zero (0) and $Z_0$, the axial cross-sectional view shown in FIG. 2B corresponds to the lateral cross-sectional views shown in FIGS. 3B–3D. More specifically, the respective inner cores 42 in each of FIGS. 2B and 3B–3D are not substantially coincident with the respective centers of the outer conductors 36. Furthermore, the inner cores 42 do not contact the outer conductors 36. Therefore, the respective characteristic impedances Z in each of FIGS. 2B and 3B–3D are $0<Z<Z_0$.

Figure 4:
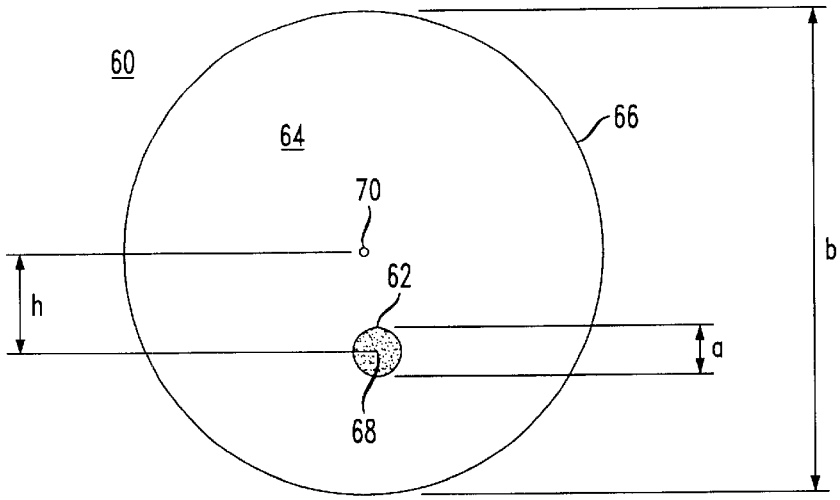
FIG. 4 illustrates a cross-sectional view of a transmission line according to the first embodiment.
Figure 5:
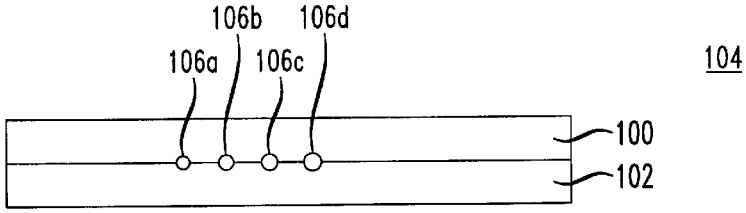
FIG. 5 illustrates a side view of the impedance selector according to a second embodiment.

FIG. 4 illustrates a cross section of a coaxial transmission line 60 having an inner core 62 surrounded by a dielectric material 64, and an outer conductor 66. A diameter of the inner core 62 is a and a diameter of the outer conductor 66 is b. A center 68 of the inner core 62 is offset from a center 70 of the outer conductor 66 by a distance h. The characteristic impedance of the coaxial transmission line 60 shown in FIG. 4 is calculated as:

$$Z = \frac{60}{\sqrt{\varepsilon}} * \left(X + \sqrt{X^2 - 1}\right), \text{ where: } X = \frac{a}{2b} + \frac{2h}{a} * \left(1 - \frac{h}{b}\right); \text{ and}$$

$\varepsilon$ = the relative permitivity of the dielectric material.

If the dielectric material is air, $\in$ is one (1).

Figure 6:
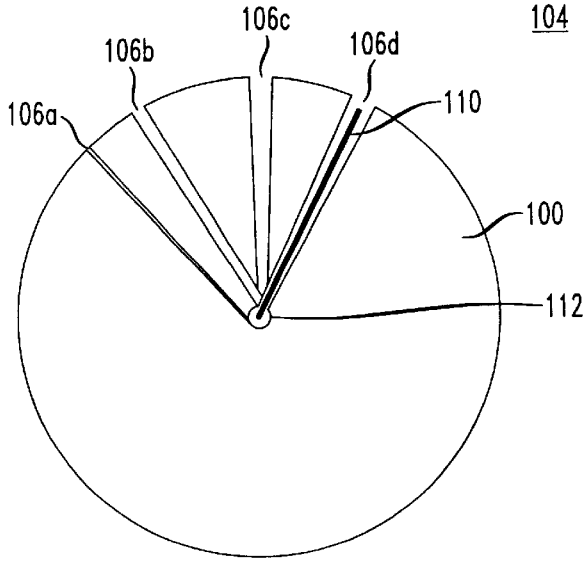
FIG. 6 illustrates a top view of the bottom plate of the impedance selector shown in FIG. 5.
Figure 7A:
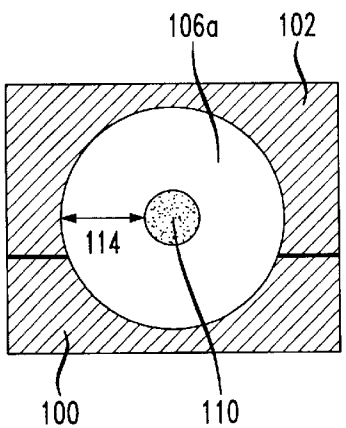
FIGS. 7A, 7B, 7C, and 7D illustrate cross-sectional views of the vias and inner conductors according to the second embodiment of the invention.
Figure 7B:
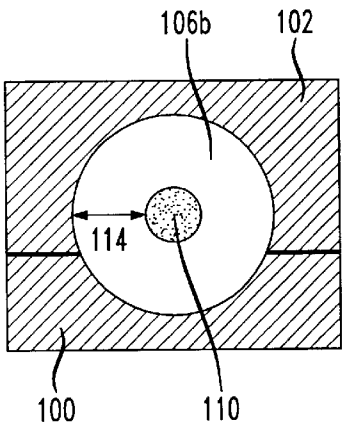
Figure 7C:
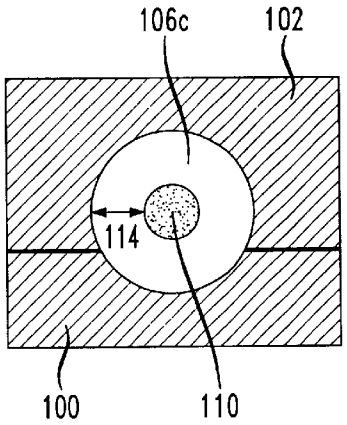
Figure 7D:
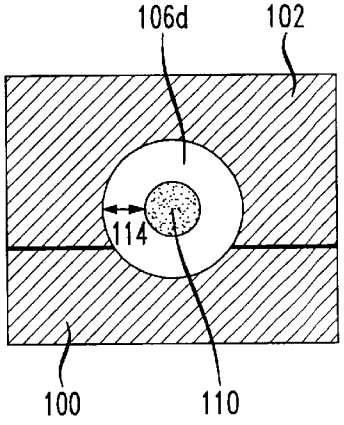

FIGS. 5, 6, and 7A–7D illustrate a second embodiment of the present invention. Bottom and top plates 100, 102, respectively, are removably secured together to form a selector 104. Respective portions of four (4) vias 106*a*, 106*b*, 106*c*, 106*d* are formed in the bottom and top plates 100, 102, respectively. The vias 106, which act as respective outer conductors, extend inward from an outer edge of the selector 104. An inner core 110 is selectively set in one (1) of the vias 106. As is best seen in FIG. 6, an input port 112, which electrically communicates with the inner core 110, extends through a center portion of the bottom plate 100. Input signals are received into the selector 104 via the input port 112. Preferably, the length of each of the outer conductors 106 (see FIG. 6) is about one-quarter wavelength of the input signals.

As shown in FIGS. 7A–7D, the outer conductors 106 have various respective diameters. More specifically, the outer conductor 106*a* shown in FIG. 7A has a largest diameter with respect to any of the outer conductors 106 shown in FIG. 7. The outer conductor 106*d* shown in FIG. 7D, on the other hand, has a smallest diameter with respect to any of the outer conductors 106 shown in FIG. 7. The outer conductors 106*b*, 106*d* shown in FIGS. 7B and 7C, respectively, have diameters between those illustrated in FIGS. 7A and 7D. Because the inner core 110 is selectively set into one (1) of the outer conductors 106, the minimum distance 114 between the respective outer conductor 106 and the inner core 110 varies as a function of which of the outer conductor 106 into which the inner core 110 is placed.

Figure 8:
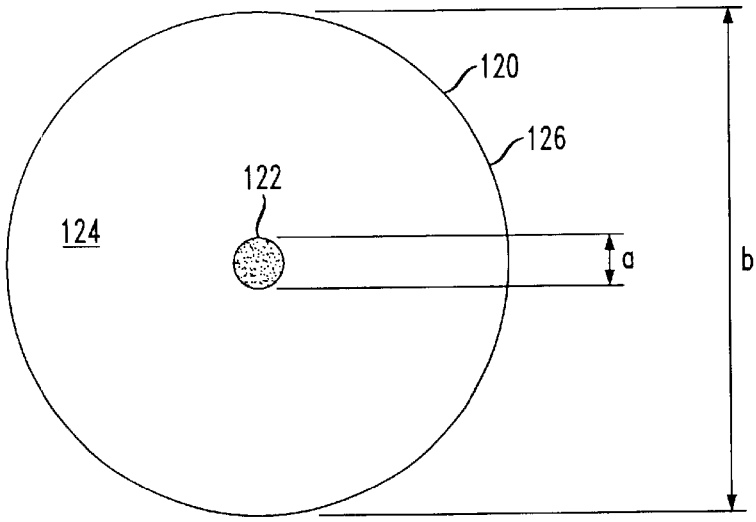
FIG. 8 illustrates a cross-sectional view of a transmission line according to the second embodiment.

FIG. 8 illustrates a cross section of a coaxial transmission line 120 having an inner core 122 surrounded by a dielectric material 124, and an outer conductor 126. A diameter of the inner core 122 is a and a diameter of the outer conductor 120 is b. A center of the inner core 122 is substantially coincident with a center of the outer conductor 120. The characteristic impedance of the coaxial transmission line 120 shown in FIG. 8 is calculated as:

$$Z = \frac{60}{\sqrt{\varepsilon}} * \ln\left(\frac{b}{a}\right),$$

where: Z=the characteristic impedance;

a=a diameter of the inner core;

b=a diameter of the outer conductor; and $\in$=a relative permitivity of the dielectric material.

With reference again to FIG. 6, the characteristic impedance of the selector 104 is set by first separating the bottom and top plates 100, 102, respectively. Then, the plates are rotated until the inner core 110 is aligned with a chosen one of the outer conductors 106. After the inner core 110 is aligned with the chosen outer conductor 106, the plates 100, 102 are secured together so that the inner core 110 is substantially concentric to the chosen outer conductor 106. In this manner, the characteristic impedance is selectively set as a function of the outer conductor 106 into which the inner core 110 is placed.

Figure 9:
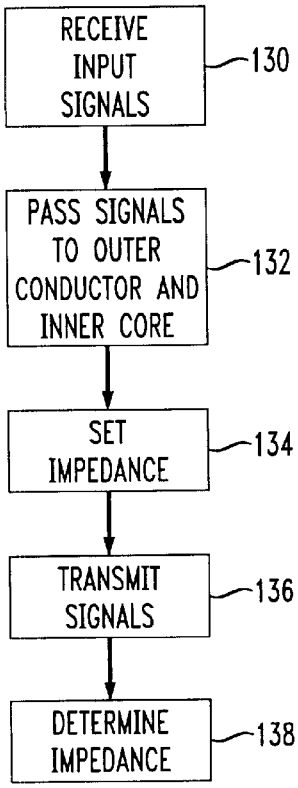
FIG. 9 illustrates a flow chart for selecting a characteristic impedance according to the present invention.

With reference to FIG. 9, input signals are received into the input port from the source connector in a step 130. The input signals are passed to the outer conductor and the inner core in a step 132. The characteristic impedance is selectively set in a step 134. Then, the selector transmits output signals to the destination connector in a step 136. The characteristic impedance is determined according to the equations discussed above in a step 138.

The invention has been described with reference to the preferred embodiment. Obviously, modifications and alterations will occur to others upon reading and understanding the preceding detailed description. It is intended that the invention be construed as including all such modifications and alterations insofar as they come within the scope of the appended claims or the equivalents thereof.

Having thus described the preferred embodiment, the invention is now claimed to be:

1. An impedance selector, including:

an input port receiving input signals;

an outer conductor electrically communicating with the input port, the outer conductor having a unitary design;

a dielectric material encircled by the outer conductor;

an inner conductive core encircled by the outer conductor and electrically communicating with the input port; and an output port electrically communicating with the input port via the outer conductor and the inner core, a characteristic impedance of the outer conductor and the inner core being selectively set as a function of a minimum distance between the inner core and the outer conductor.

2. The impedance selector as set forth in claim 1, wherein the outer conductor moves with respect to the inner conductive core, the minimum distance changing as a function of selected rotational positions of the outer conductor and the inner conductive core.

3. The impedance selector as set forth in claim 2, wherein the characteristic impedance decreases as the minimum distance decreases.

4. The impedance selector as set forth in claim 3, wherein an electrical short is created between the inner core and the outer conductor in one of the selected rotational positions.

5. The impedance selector as set forth in claim 2, wherein the characteristic impedance is calculated as:

$$Z = \frac{60}{\sqrt{\varepsilon}} * \left(X + \sqrt{X^2 - 1}\right),$$

where: Z=the characteristic impedance;

$$X = \frac{a}{2b} + \frac{2h}{a} * \left(1 - \frac{h}{b}\right);$$

a=a diameter of the inner core;

b=a diameter of the outer conductor;

h=a distance between a center of the inner core and a center of the outer conductor; and ∈=a relative permitivity of the dielectric material.

6. The impedance selector as set forth in claim 2, further including:

a motor device for rotating the outer conductor to the selected rotational positions.

7. The impedance selector as set forth in claim 2, wherein the outer conductor, and the inner conductive core are substantially cylindrically-shaped.

8. The impedance selector as set forth in claim 2, wherein a length of the outer conductor is about one-quarter wavelength of the input signals.

9. An impedance matching device, including:

an input port receiving input signals;

an outer conductor electrically communicating with the input port, the outer conductor having a unitary design;

a dielectric material surrounded by the outer conductor;

an inner conductive core positioned within the outer conductor and electrically communicating with the input port, a radial center of the inner core moving relative to a radial center of the outer conductor as the outer conductor rotates around the inner core; and an output port electrically communicating with the input port, via the outer conductor and the inner core, a characteristic impedance of the outer conductor and the inner core being selectively set as a function of a distance between the respective radial centers of the inner core and the outer conductor.

10. The impedance matching device as set forth in claim 9, wherein:

a maximum characteristic impedance is achieved when the respective radial centers of the inner core and the outer conductor are coaxial; and the characteristic impedance decreases as the distance between the respective radial centers of the inner core and the outer conductor increases.

11. The impedance matching device as set forth in claim 10, wherein an electrical short occurs when the inner core contacts the outer conductor.

12. The impedance matching device as set forth in claim 9, further including:

a source connector electrically connected to the input port; and a destination connector electrically connected to the output port, the characteristic impedance being selectively set for substantially matching respective impedances of the source and destination connectors.

13. The impedance matching device as set forth in claim 9, wherein the dielectric material includes a gas.

14. A method of selecting an impedance for transforming an impedance of a source connector to substantially match an impedance of an output connector, including:

receiving input signals from the source connector into an input port;

passing the input signals to an outer conductor and an inner conductive core electrically communicating with the input port, the outer conductor having a unitary design and encircling both the inner conductive core and a dielectric material;

selectively setting a characteristic impedance of the outer conductor and the inner core as a function of a minimum distance between the inner core and the outer conductor; and outputting output signals to the output connector.

15. The method of selecting an impedance as set forth in claim 14, further including:

selectively rotating a rotation device to a rotational position for achieving the characteristic impedance, the minimum distance between the inner core and the outer conductor changing as a function of the rotational position, the inner core being non-concentrically secured within the rotation device.

16. The method of selecting an impedance as set forth in claim 15, wherein:

for achieving a maximum characteristic impedance, the step of rotating includes:

rotating the rotation device for achieving a largest minimum distance between the inner core and the outer conductor;

for achieving a minimum characteristic impedance, the step of rotating includes:

rotating the rotation device for achieving a smallest minimum distance between the inner core and the outer conductor.

17. The method of selecting an impedance as set forth in claim 15, wherein for achieving a short circuit, the step of rotating includes:

rotating the rotation device to a position in which the inner core contacts the outer conductor.

18. The method of selecting an impedance as set forth in claim 14, further including:

determining respective characteristic impedances at respective rotational positions of the rotation device according to:

$$Z = \frac{60}{\sqrt{\varepsilon}} * \left(X + \sqrt{X^2 - 1}\right),$$

where: Z=the characteristic impedance;

$$X = \frac{a}{2b} + \frac{2h}{a} * \left(1 - \frac{h}{b}\right);$$

a=a diameter of the inner core;

b=a diameter of the outer conductor;

h=a distance between a center of the inner core and a center of the outer conductor; and ∈=a relative permitivity of the dielectric material.

* * * * *